US005227853A

United States Patent [19]

Proulx et al.

[11] Patent Number: 5,227,853

[45] Date of Patent: Jul. 13, 1993

[54] COMPLIANT FUSING ROLLER

[75] Inventors: Rodney Proulx, Webster, N.Y.; Robert Simms, Downingtown, Pa.

[73] Assignee: Xerox Corporation, Stamford, Conn.

[21] Appl. No.: 777,191

[22] Filed: Oct. 16, 1991

[51] Int. Cl.[5] ..... G03G 15/20; B21B 31/08

[52] U.S. Cl. ..... 355/282; 219/216; 355/285; 355/290; 492/46; 492/56

[58] Field of Search ..... 355/282, 285, 289, 290, 355/295, 23, 24; 430/98, 99, 124; 29/130, 132; 219/216; 432/60; 118/60

[56] References Cited

U.S. PATENT DOCUMENTS

| | | | |
|---|---|---|---|
| Re. 33,770 | 12/1991 | Torino et al. | 355/290 |
| 3,893,761 | 7/1975 | Buchan et al. . | |
| 4,149,797 | 4/1979 | Imperial | 29/132 X |
| 4,448,872 | 5/1984 | Vandervalk . | |
| 4,501,482 | 2/1985 | Stryjewski . | |
| 4,674,857 | 6/1987 | Satomura et al. . | |
| 4,771,318 | 9/1988 | Noguchi | 355/24 X |
| 4,814,819 | 3/1989 | Torino et al. | 355/282 |
| 4,842,944 | 6/1989 | Kuge et al. | 355/285 X |
| 4,883,715 | 11/1989 | Kuge et al. | 29/132 X |
| 4,887,340 | 12/1989 | Kato et al. . | |
| 4,910,559 | 3/1990 | Kuge et al. | 355/285 |
| 4,949,130 | 8/1990 | Torino | 355/282 |
| 4,987,457 | 1/1991 | Mochizuki et al. | 355/285 X |
| 4,998,333 | 3/1991 | Skytta . | |
| 5,014,406 | 5/1991 | Kato et al. . | |
| 5,051,780 | 9/1991 | Stelter et al. | 355/285 X |
| 5,070,371 | 12/1991 | Randall | 355/24 X |
| 5,070,372 | 12/1991 | Randall | 355/272 |
| 5,075,732 | 12/1991 | Menjo | 355/282 |
| 5,095,342 | 3/1992 | Farrell et al. | 355/24 X |
| 5,099,289 | 3/1992 | Kurotori et al. | 355/290 |
| 5,099,560 | 3/1992 | Kato et al. | 29/130 |

FOREIGN PATENT DOCUMENTS

| | | | |
|---|---|---|---|
| 0173279 | 8/1986 | Japan | 355/290 |

*Primary Examiner*—A. T. Grimley
*Assistant Examiner*—Matthew S. Smith
*Attorney, Agent, or Firm*—Oliff & Berridge

[57] ABSTRACT

A duplex fusing system has a pressure roller which includes a compliant surface which evenly distributes contact pressures to reduce displacement of a previously fused image. The compliant layer conforms to the surface of a substrate sheet and toner on that surface, thereby ensuring that the toner does not migrate when the toner is reheated to a liquid state.

31 Claims, 1 Drawing Sheet

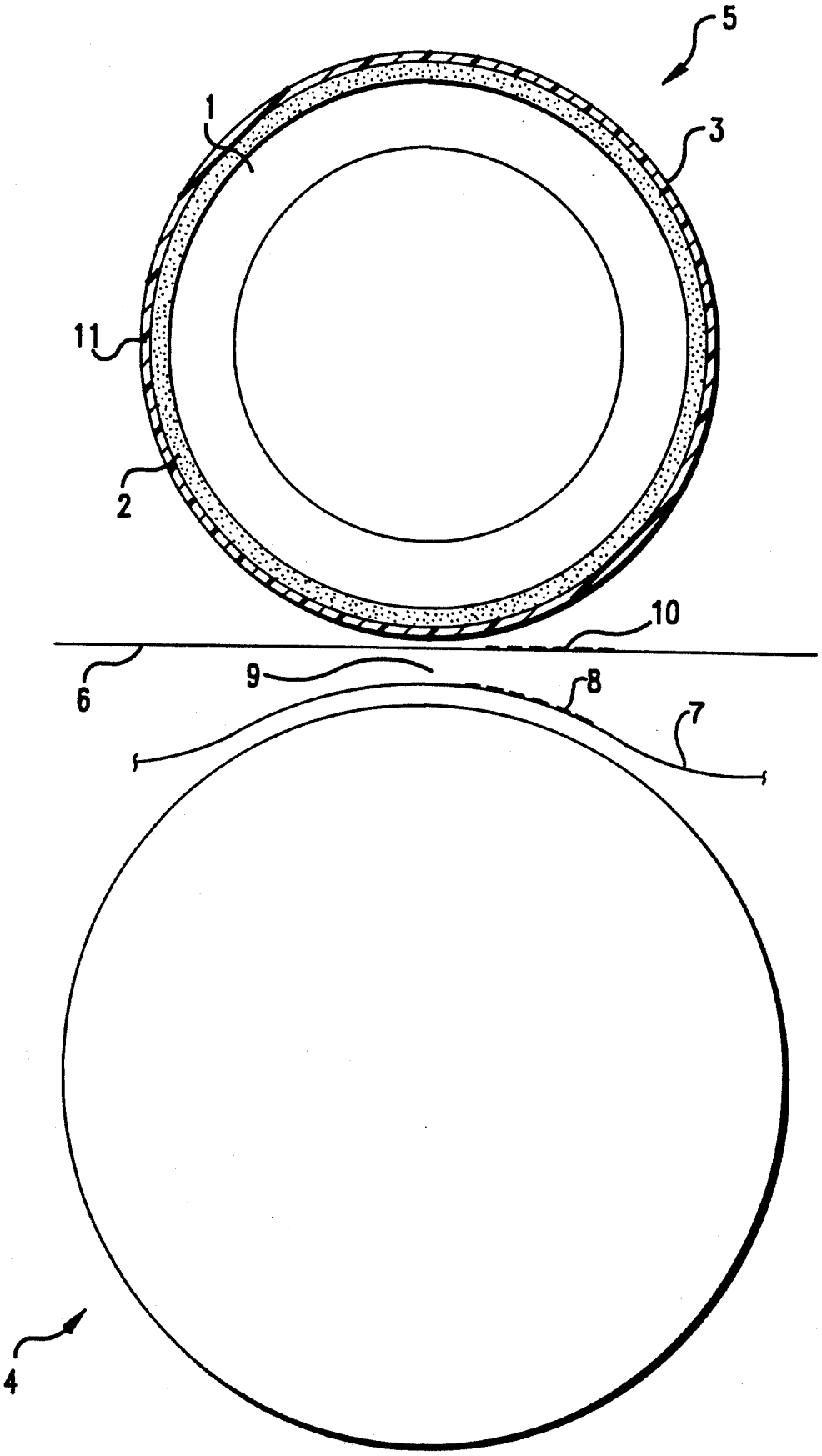
5
1
3
11
2
10
6
9
8
7
4

COMPLIANT FUSING ROLLER

FIELD OF THE INVENTION

This invention relates to a duplex image fusing system having a pressure roller comprised of a compliant surface which enables the fusing of an image on a second side of a previously imaged substrate sheet as part of the duplex cycle.

BACKGROUND OF THE INVENTION

Developed toner images in electrostatographic processes can be transferred and fused to another substrate such as paper. For convenience, this substrate will generally be referred to herein as "paper", although those of skill in the art will appreciate that other materials such as textiles, plastics, etc. are equivalent to paper for the purposes of this invention. Transfer of the toner image can be accomplished by electrostatic methods, by the use of adhesive coated paper, by pressure contact, or by other means. Once transferred, the toner image can be fused or fixed to the paper by heating and cooling, solvent fusing, applying a fixed coating over the image, etc.

In some cases, toner images are transferred to intermediate sheets or belts prior to fusing on a copy substrate.

In processes in which a toner image is fused or fixed to the paper by heating and pressure, the toner of the toner image is frequently displaced as the toner is pressed into the paper by the pressure roller. This results in an image with a lower resolution than desired.

In U.S. Pat. No. 3,893,761 (Buchan et al.), a xerographic heat and pressure transfer and fusing apparatus includes an intermediate transfer member which has a smooth surface, a surface free energy below 40 dynes per centimeter and a hardness from 3 to 70 durometers. Means are provided for transferring a toner image from a first support material onto the surface of the intermediate transfer member. The toner on the intermediate transfer member is then heated to a temperature at which it will flow when a sufficient force is applied thereto. A second support material is brought into pressure contact with the heated toner on the intermediate transfer member. This procedure is said to result in improved toner transfer and fusing, especially when the toner is selectively heated and the force is applied in such a manner that the resulting pressure pulse has a steep rise time. This is said to result in higher resolution in the final copy.

U.S. Pat. No. 4,501,482 (Stryjewski) discloses a fuser member made out of a compliant material which may be used to apply heat and pressure to a toner image carried by a receiver to fuse the image without introducing fuser-related image defects. The fuser member is comprised of an elastomeric material which is solid at room temperatures but which becomes fluid at fusing temperatures, thus changing the compliancy of the elastomeric material. In U.S. Pat. No. 4,998,333 (Skyttä), a roll for a press of a paper machine or the like is comprised of a rigid shell body and a resilient layer made of rubber located around the shell body. The resilient layer is formed by rubber profiles which are easy to fasten to the shell body by vulcanizing. When the roll is compressed in a nip in a radial direction, the profiles are thereby able to expand in the peripheral direction of the roll into conduits, making the deformation easier and reducing the amount of friction heat created.

U.S. Pat. Nos. 4,887,340 and 5,014,406 (Kato et al.) disclose a fixing roller for use in a fixing stage of an apparatus such as a copier machine. The fixing roller is comprised of multiple rubber or fabric layers of a certain thickness and hardness which surround a core member. The fixing roller is comprised of a roller core, a first heat-resistant rubber layer provided on the outer surface of the core, a second heat-resistant rubber layer provided on an outer surface of the first rubber layer, and a thin third heat-resistant rubber layer surrounding the second layer.

None of the references described above address one of the fundamental problems encountered in duplex image fusing.

In duplex printing machines such as copiers, an image is first heat fused to one side of a substrate sheet, such as paper. Then, another image is heat fused to the other side of that same substrate sheet. Consequently the first image is reheated while the second image is being heat fused. Specifically, two changes in the condition of the first image take place as it is reheated. First, as the existing image is reheated, the image softens and is less able to withstand the unevenly distributed forces the roll pressure exerts over the surface of the paper. This creates a thinner toner layer over paper fibers that protrude from the paper surface, effectively reducing the image density. Second, with the application of heat, the toner changes from a solid to a viscous liquid. This liquid is able to flow in the cavity between the roll surface and the paper surface. Image defects are created when a toner "bridge" over deep paper irregularities is reheated and flows. Upon heating, the toner material does not readily wet the low surface energy roll coating. Because it also has not wetted the paper beneath it, the melted material is governed by its cohesive nature. Cellular areas form around the perimeter of the most severe surface irregularities, creating small areas which lack toner.

U.S. Pat. No. 4,448,872 (Vandervalk) discloses a method and apparatus for electrostatic imaging wherein a toner image is transferred and simultaneously fixed to two sides of a receptor medium using high pressure. In this patent, a transfer roll has a smooth compliant surface which comprises a thermoplastic or thermoset material characterized by a low coefficient of friction so as to provide high transfer efficiency to a receptor sheet. The simultaneous fixing requires a number of additional mechanical features to be built into the copier, and does not involve reheating of a previously fused image.

U.S. Pat. No. 4,674,857 (Satomura et al) discloses a duplex image recording apparatus which includes a rotatable transfer member and a plurality of latent image bearing members which are in rolling press-contact with the transfer member. The rotatable transfer member comprises a rigid cylinder with a surface layer of a synthetic resin having compressive resiliency. In this device the front and back sides of a recording sheet either simultaneously receive the respective images or an overprint recording can be effected. Both of these devices are more complex than the standard duplex copier and require more moving parts, due to the fact that both sides of the copy sheet are being printed simultaneously.

SUMMARY OF THE INVENTION

An object of the present invention is to minimize image disturbance in heat and pressure duplex fusing systems by providing a low durometer elastomer outer surface on the pressure roller. The elastomer provides improved surface compliance which improves the pressure distribution. Additionally, improved surface compliance ensures that the surface contacts more of the paper surface, resulting in a reduction in the cellular defect level.

BRIEF DESCRIPTION OF THE DRAWING

The FIGURE is a cross section of a duplex fusing system of the invention.

DETAILED DESCRIPTION OF PREFERRED EMBODIMENTS

The present invention is for a duplex fusing system. The fusing system can be used in any toner-based duplex printing machines, such as copiers (e.g., electrophotographic or ionographic), laser printers and the like. For convenience, the following discussion will focus on copying applications.

The system of the invention includes a fusing nip where a copy sheet is subjected to heat and pressure. Preferably, a heating roller and a pressure roller form the fusing nip. The pressure roller may also be a heating roller. The pressure roller is very compliant, and thereby evenly distributes contact pressures to reduce image displacement by conforming to a copy sheet and a toner image on the copy sheet facing the pressure roller. This arrangement insures that the toner forming the toner image does not migrate when melted during fusing of an image on an opposite side of the copy sheet. In a preferred embodiment, the pressure roller is comprised of a core, a compliant backing layer covering the core, and a compliant overcoat layer covering the compliant backing layer.

As shown in the FIGURE, a heating roller 4 may be positioned opposite a copy sheet pressure roller 5. Pressure roller 5 is comprised of a core 1 which may be comprised of a thermally conductive roll, preferably made out of steel, nickel, or some other suitable metal or alloy. The core may be made out of aluminum, preferably about one-half inch to about one inch in thickness, and more preferably about three-fourths of an inch in thickness.

On top of the core is deposited a compliant backing layer. The compliant backing layer is preferably from one-eighth to about five-eighths inch thick with a hardness of about 60 shore Å to about 85 shore Å. The compliant backing layer is preferably comprised of a thermally and/or electrically conductive material such as silicon rubber. Overlayed on the compliant backing layer is a coating layer 11 which is dimensionally stable, compatible with any toner dispersant (e.g., Isopar), and can withstand a curing temperature of about 500° F. The coating layer 11 chemically isolates the silicon rubber from the toner dispersant and serves to dimensionally stabilize a compliant overcoat layer 3. In a preferred embodiment, the coating layer 11 is comprised of Kapton ®, a polyamine. The compliant backing layer 2 is preferably adhered to the core 1 by a high temperature adhesive.

Overlayed on coating layer 11 is compliant overcoat layer 3, preferably with a thickness of about two thousandths to about eight thousandths of an inch, a hardness of about 30 shore Å to about 70 shore Å, and a surface roughness having an amplitude of no more than about 2 microns and a wavelength of no less than about 10 microns. The compliant overcoat layer 3 should have a low coefficient of friction with a surface energy of no more than about 20 to about 25 dynes/cm. Compliant overcoat layer 3 is preferably elastomeric, compatible with the toner and any toner dispersant (e.g., Isopar) being used, and has a low surface energy. In a preferred embodiment, the overcoat layer is comprised of Viton B50, a fluorosilicon elastomer, which has been spray coated onto coating layer 11. The compliant overcoat layer may also be comprised of natural or synthetic rubbers.

In a duplex fusing system the invention, a copy sheet or substrate 6 passes through a nip 9 formed between the copy sheet pressure roller 5 and the heating roller 4. Also passing through nip 9 may be an intermediate belt or sheet 7 upon which has been deposited a toner image 8. While both the copy sheet 6 and the intermediate belt or sheet 7 are passing through the nip 9, the toner of the toner image 8 is pressed against the copy sheet 6. Under pressure from the copy sheet pressure roller 5, the toner of the toner image 8 is melted by the heat from the heating roller 4. The toner goes onto the copy sheet or substrate 6 which, having a higher surface energy than that of the intermediate belt or sheet 7, retains the toner. As the copy sheet 6 and the intermediate belt exit the nip 9, the intermediate belt 7 and the copy sheet 6 separate and the toner cools, hardening on the copy sheet 6. Alternatively, the unfused toner image may be transferred to the copy sheet 6 prior to the fusing stage, in which case the intermediate belt or sheet 7 will not pass through the fusing nip and may be completely eliminated.

When, in the duplex copier system, the same copy sheet 6 returns to the nip 9 for image transfer to the second side, the fused image bearing side of the copy sheet 6 is facing the copy sheet pressure roller 5 so that the second image 8 can be fused on the backside of the same copy sheet 6. The intermediate belt 7 (if present), carrying a new toner image 8, enters the nip 9 and is again facing and is pressed against the copy sheet 6. As the heat of the heating roller 4 melts the toner of the toner image 8, the toner image 10 already placed on the copy sheet 6 and facing the copy sheet pressure roller 5 begins to melt. However, due to the low surface energy of the compliant overcoat layer 3, the toner of the first image 10 placed on the front side of the copy sheet 6 does not adhere to the compliant overcoat layer 3. As the overcoat layer 3 is highly compliant, this layer 3 prevents migration of the ink or toner on the copy sheet, thus avoiding reduction of the resolution of the image or image disturbance.

The improved surface compliance of the pressure roller improves the pressure distribution on the first image and the paper being reheated. This improved surface compliance ensures that the roller contacts more of the surface, resulting in a reduction in the cellular defect level. The low surface energy minimizes "pick-off" of the toner from the image on the paper that is being reheated.

Thus by having improved surface compliance and by contacting the reheated image with a surface having a low surface energy, the problems discussed above are overcome.

When both the intermediate belt 7 and the copy sheet 6 exit the nip 9, the copy sheet 6 cools on both sides and there is minimal loss of the high resolution image obtained in the machine. This system enables high quality to be maintained in the duplex mode and is applicable to either dry or liquid toner technologies.

While the invention has been described with reference to the structures and embodiments disclosed herein, it is not confined to the details set forth, and this application is intended to cover such modifications or changes as may come within the purpose of the improvements and the scope of the following claims.

What is claimed is:

1. A duplex toner image fusing system comprising a heating roller and a pressure roller forming a fusing nip, said pressure roller having a compliant outer surface with a hardness of no more than about 70 Shore Å and having roughness of an amplitude of no greater than about two microns and a wavelength no less than about ten microns, wherein said compliant outer surface evenly distributes contact pressures to reduce image displacement, said compliant outer surface conforming to a substrate surface and a toner image on said substrate surface facing said compliant outer surface thereby avoiding migration of toner forming said first toner image when melted during fusing of an image on an opposite side of a substrate in said duplex image fusing system.

2. A duplex fusing system according to claim 1, wherein said compliant outer surface is about 0.002 inch thick to about 0.008 inch thick.

3. A duplex fusing system according to claim 1, wherein said compliant outer surface is comprised of a material selected from the group consisting of natural and synthetic rubbers.

4. A duplex fusing system according to claim 1, further comprising a core and a compliant backing layer covering said core.

5. A duplex fusing system according to claim 4, further comprising a coating layer positioned between said compliant backing layer and said compliant outer surface.

6. A method of fusing duplex images, comprising:

forming a fused first toner image on one side of a substrate sheet; and subsequently forming a second toner image on an opposite side of said substrate sheet, and fusing said second toner image by application of pressure and heat to said substrate sheet in a nip between a pressure roller and a heating roller;

wherein said fused first toner image is melted and contacts said pressure roller while fusing said second toner image, said pressure roller comprising a compliant outer surface with a compliant backing layer, said compliant outer surface characterized by a lower durometer than the durometer of said compliant backing layer, such that said compliant outer surface evenly distributes contact pressures to reduce image displacement, said compliant outer surface conforming to a substrate surface and the first toner image on said substrate surface facing said outer surface thereby avoiding migration of toner forming said first toner image when melted during fusing of said second toner image on an opposite side of the substrate when fusing said duplex image.

7. The method according to claim 6, wherein said compliant outer surface is about 0.002 inch thick to about 0.008 inch thick.

8. The method according to claim 6, wherein said compliant outer surface is comprised of a material selected from the group consisting of natural and synthetic rubbers.

9. The method according to claim 6, wherein said compliant outer surface has a surface roughness of an amplitude no greater than about two microns and a wavelength no less than about ten microns.

10. The method according to claim 6, said pressure roller further comprising a core, the compliant backing layer covering said core.

11. The method according to claim 10, said pressure roller further comprising a coating layer positioned between compliant backing layer and said compliant outer surface.

12. The method according to claim 6, wherein said first and second toner images are transferred from an intermediate sheet to said substrate sheet while said intermediate sheet and said substrate sheet are passing through said nip.

13. A duplex fusing system comprising a heating roller and a pressure roller, said pressure roller comprising:

a core;

a compliant backing layer covering said core; and an elastomeric compliant overcoat layer covering said compliant backing layer, wherein said elastomeric compliant overcoat layer is characterized by a lower durometer than the durometer of said compliant backing layer and evenly distributes contact pressures to reduce image displacement, said compliant overcoat layer conforming to a substrate surface and a toner image on said substrate surface facing said overcoat layer thereby avoiding migration of toner forming said toner image when melted during fusing of an image on an opposite side of the substrate in said duplex image fusing system.

14. A duplex fusing system according to claim 13, wherein said compliant backing layer is about 0.1 inch to about 0.6 inch thick.

15. A duplex fusing system according to claim 13, wherein said compliant overcoat layer is from about 0.002 inch thick to about 0.008 inch thick.

16. A duplex fusing system according to claim 13, wherein said compliant backing layer has a hardness of about 60 shore Å to about 85 shore Å.

17. A duplex fusing system according to claim 13, wherein said compliant overcoat layer has a hardness of about 30 shore Å to about 70 shore Å.

18. A duplex fusing system according to claim 13, wherein said compliant backing layer is comprised of a thermally conductive material.

19. A duplex fusing system according to claim 13, wherein said compliant backing layer is comprised of an electrically conductive material.

20. A duplex fusing system according to claim 13, wherein said compliant backing layer is selected from a group consisting of natural and silicon rubbers.

21. A duplex fusing system according to claim 13, wherein said compliant overcoat layer is comprised of a material selected from the group consisting of natural and synthetic rubbers.

22. A duplex fusing system according to claim 13, further comprising a high temperature adhesive adhering said compliant backing layer to said core.

23. A duplex fusing system according to claim 13, wherein the overcoat layer has a smooth surface, said surface having surface roughness of an amplitude no greater than two microns and a wavelength no less than about ten microns.

24. A duplex fusing system according to claim 13, wherein said overcoat layer has a surface energy of no more than 20–25 dynes/cm.

25. A duplex fusing system according to claim 13, further comprising a coating layer positioned between said backing layer and said overcoat layer.

26. A duplex fusing system according to claim 25, wherein said coating layer is comprised of an electrically conductive material.

27. A duplex fusing system according to claim 25, wherein said coating layer is comprised of a thermally conductive material.

28. A duplex fusing system according to claim 25, wherein said coating layer is dimensionally stable.

29. A duplex fusing system according to claim 25, wherein said coating layer is comprised of a polyamine.

30. A duplex fusing system according to claim 25, wherein said coating layer is compatible with any toner dispersant.

31. A duplex fusing system according to claim 13, wherein said compliant overcoat layer is comprised of a fluorosilicon elastomer.

* * * * *